United States Patent [19]

Goloff

[11] 4,326,672

[45] Apr. 27, 1982

[54] ROTARY FUEL INJECTION APPARATUS

[75] Inventor: Alexander Goloff, East Peoria, Ill.

[73] Assignee: Caterpillar Tractor Co., Peoria, Ill.

[21] Appl. No.: 234,085

[22] Filed: Feb. 13, 1981

Related U.S. Application Data

[63] Continuation of Ser. No. 88,723, which matured from PCT/US79/00587, filed Aug. 8, 1979, 102(e) date Aug. 8, 1979, § 371 date Aug. 8, 1979, abandoned.

[51] Int. Cl.[3] ..... F02M 47/02; F02M 55/02; F02M 61/04; F02M 63/04

[52] U.S. Cl. ..... 239/91; 123/450; 239/95; 239/125; 239/574; 251/309

[58] Field of Search ..... 239/87–96, 239/124, 125, 127, 533.5, 574, 585; 137/624.13, 625.11; 251/133, 138, 309; 123/450, 458

[56] References Cited

U.S. PATENT DOCUMENTS

| | | | |
|---|---|---|---|
| 2,356,627 | 8/1944 | Skaredoff | 417/502 |
| 2,447,423 | 8/1948 | Nies | 137/625.11 |
| 2,729,167 | 1/1956 | Links | 417/502 |
| 3,068,793 | 12/1962 | Morris | 123/448 X |
| 3,090,369 | 5/1963 | Corlew | 123/450 |
| 3,779,225 | 12/1973 | Watson et al. | 123/139 E |
| 3,859,972 | 1/1975 | Watson et al. | 123/139 E |
| 3,880,131 | 4/1975 | Twaddell et al. | 123/139 E |
| 4,129,253 | 12/1978 | Bader, Jr. et al. | 239/88 |
| 4,146,178 | 3/1979 | Bailey | 239/90 |

FOREIGN PATENT DOCUMENTS

| | | | |
|---|---|---|---|
| 914080 | 6/1954 | Fed. Rep. of Germany . | |
| 1917927 | 10/1970 | Fed. Rep. of Germany . | |
| 2211598 | 7/1974 | France . | |
| 410781 | 6/1945 | Italy | 251/309 |
| 295967 | 8/1928 | United Kingdom . | |

*Primary Examiner*—Andres Kashnikow
*Attorney, Agent, or Firm*—Paul S. Lempio

[57] ABSTRACT

Fuel injection apparatus often uses valves which rapidly move in a start and stop motion for the purpose of starting and stopping injection. Undesirable inertial forces result from such start-stop movement of the valves. To limit such undesirable forces, a pair of valves (72,92) are provided for continuous rotation for starting and stopping injection.

24 Claims, 6 Drawing Figures

FIG. 2.
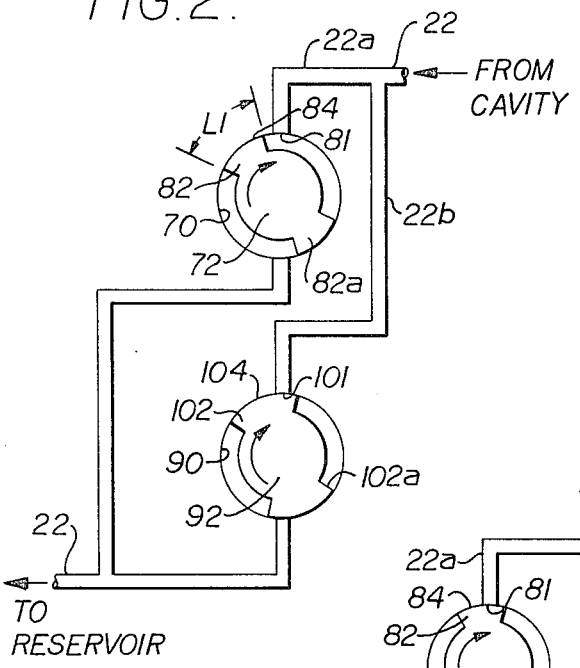
FIG. 2A.
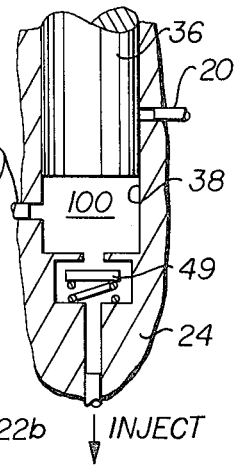
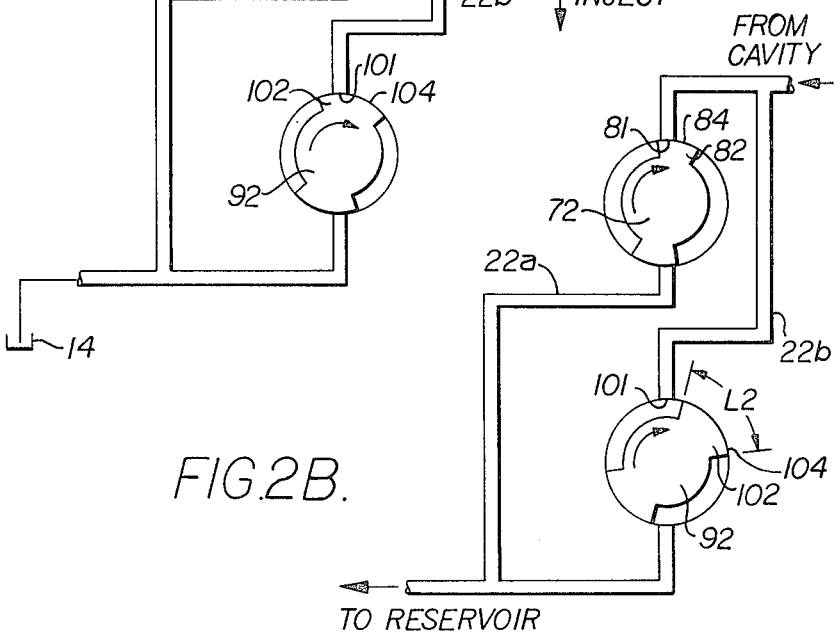
FIG. 2B.

ROTARY FUEL INJECTION APPARATUS

This is a continuation of Ser. No. 88,723, which matured from PCT/US79/00587, filed Aug. 8, 1979, 102(e) date Aug. 8, 1979, § 371 date Aug. 8, 1979, now abandoned.

DESCRIPTION

TECHNICAL FIELD

This invention relates generally to internal combustion engines and more particularly to those having electrically controlled fuel injection.

BACKGROUND ART

Electrical control of fuel injection is versatile and thus advantageous. In general, it allows accomplishment of several important objectives such as excellent control of exhaust emissions; improved engine response; programming of desired torque characteristics of the engine; programming of desired speed regulations; provision for rapid shutdown of engines; and improved fuel economy.

Controlling the amount of fuel injected into an engine has been accomplished in the prior art by a single linearly acting or reciprocating solenoid controlled valve. However, relatively large amounts of electrical energy are required to start and stop a reciprocating mass. Further, rapidly reciprocating masses which start and stop several times per second produce relatively large inertial forces which can cause an undesirable vibration or bounce. Also, it is difficult to satisfactorily lubricate such reciprocating valves and reduce friction since a continuous oil film is difficult to develop when rapidly reciprocating one member within another.

As an improvment, novel apparatus was provided with dual linearly acting or reciprocating valves which are solenoid controlled to move from a first to a second position and which are resiliently urged to return from the second to the first position. This novel apparatus avoided some of the relatively large inertial forces common to single reciprocating valves.

As a further improvement, novel apparatus was provided with a single rotary controlled valve which significantly reduced some of the inertial forces common to reciprocating valves and provided an improvement over the lubrication problems associated with reciprocating valves. The single rotary controlled valve operated in start-stop manner which caused only slight inertial forces.

In view of the above, it would be advantageous to provide a rotary controlled fuel injection apparatus for controlling the amount of fuel injected into an engine which further reduces such inertial forces as an alternative solution to the problems associated with the prior art.

DISCLOSURE OF INVENTION

In one aspect of the present invention, this is accomplished by providing a rotary fuel injection apparatus including a housing having a plunger reciprocably mounted in a plunger bore. First and second continuously rotating valves are fluidly connected to the plunger bore and are provided for starting and stopping fuel injection.

The foregoing and other aspects will become apparent from the following detailed description of the invention when considered in conjunction with the accompanying drawings. It is to be expressly understood, however, that the drawings are not intended as a definition of the invention but are for the purpose of illustration only.

BRIEF DESCRIPTION OF THE DRAWINGS

In the drawings:

FIGS. 2, 2A and 2B are partial views sequentially illustrating fuel injection with the apparatus of the invention;

BEST MODE FOR CARRYING OUT THE INVENTION

Figure 1:
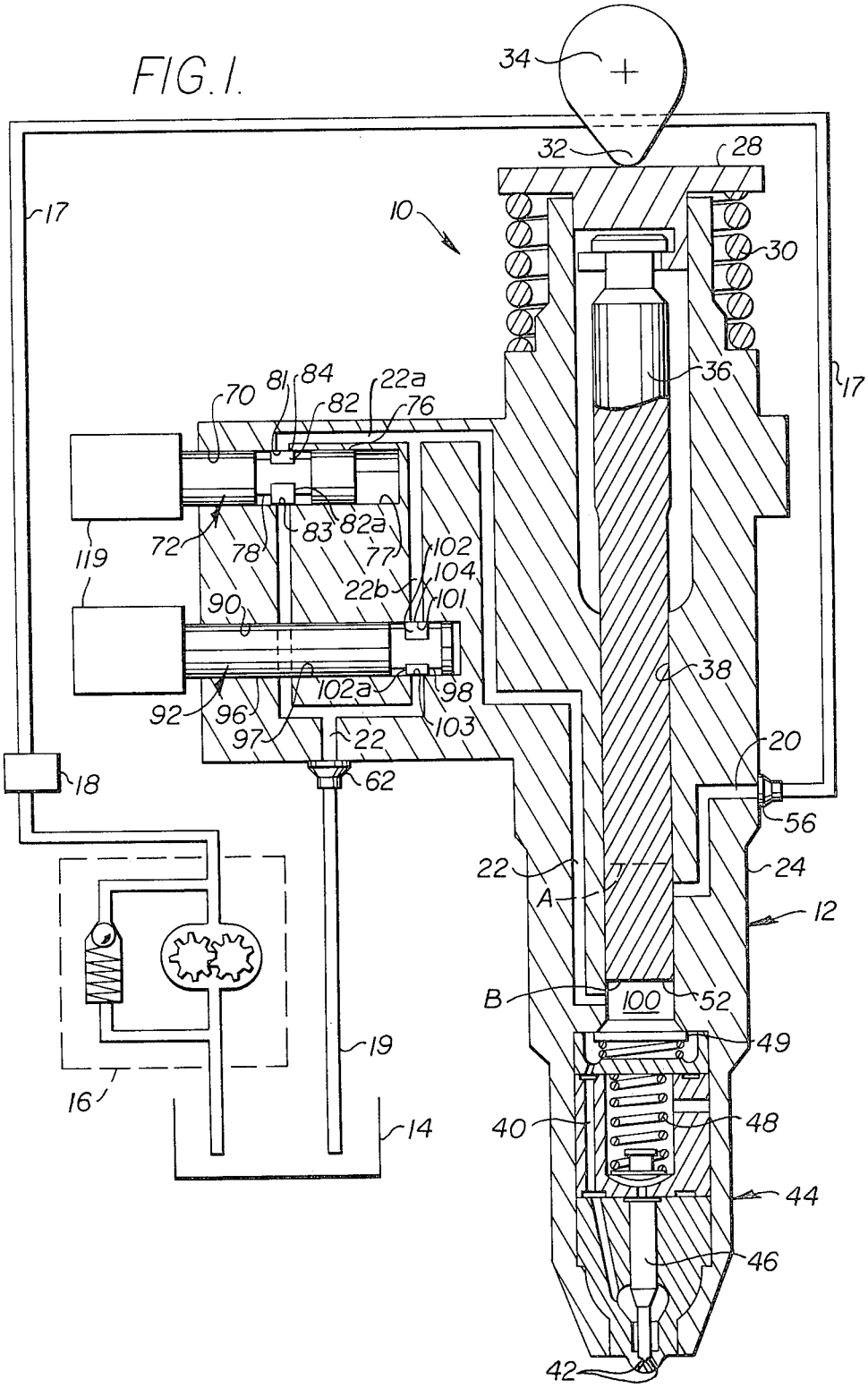
FIG. 1 is a view illustrating the apparatus and system of this invention.

In FIG. 1, a unit fuel injection apparatus is designated 10 and includes a unit fuel injector pump 12 operatively connected in a system including a known fuel supply tank or reservoir 14 from which fuel is transferred to the fuel injector pump 12 by a known fuel transfer pump 16, preferably through a filter 18. The fuel is supplied to a housing 24 through a conduit 17. Fuel enters housing 24 at an inlet port 56 of fuel conduit 20. Fuel exits from a fuel conduit 22 in housing 24 at an outlet port 62 and is conducted back to tank 14 through a conduit 19.

Unit fuel injection pump 12 includes housing 24 having a tappet 28 resiliently biased by spring 30 and driven by a lobe 32 on a camshaft 34 as is well known. As a result, a plunger 36 is a means for reciprocating in a first bore 38 within housing 24. Fuel, delivered to first bore 38, is injected into an engine cylinder (not shown) past a oneway check valve 49, through an injection passage 40 and an injection port 42 in a tip assembly 44. This well known arrangement functions due to differential areas on a fuel injection valve 46 biased by a spring 48 in tip assembly 44.

The fuel is expelled through port 42 due to its substantial pressurization periodically occurring in a cavity 100 of first bore 38 as plunger 36 continuously reciprocates. Controlling the quantity and timing of the injection of fuel through port 42 is the subject of much technology due to present trends in enhancing fuel economy and reducing fuel emissions. Such technology is complicated because the control of quantity and timing must be coordinated with other engine functions and conditions. Since the lobe 32 and plunger 36 have a fixed cyclical relationship for pressurizing the fuel in first bore 38, variations in controlling quantity and timing of injection usually involve electrical and/or mechanical control of the admittance of fuel to first bore 38. For example, this has been accomplished by a scroll (helix) on the plunger which is rotated with a rack. As illustrated, plunger 36 reciprocates between a dotted line position "A" and a solid line position "B".

Fuel conduit 20 extends into housing 24 from port 56 and terminates at bore 38 adjacent an end 52 of plunger 36. Thus, conduit 20 functions as a means for conducting fuel to cavity 100 of plunger bore 38. Fuel conduit 22 extends from cavity 100 of plunger bore 38, through housing 24 to port 62. Thus, conduit 22 functions as a means for conducting fuel from plunger bore 38.

Conduit 20 is in fluid communication with cavity 100 when plunger 36 is in position "A" but not in position "B". Conduit 22 is in fluid communication with cavity 100 when plunger 36 is in any position between "A" and "B". Conduit 22 separates or diverges to form a first branch or conduit portion 22*a* between cavity 100 and outlet port 62 and a second separate branch or conduit portion 22*b* between cavity 100 and outlet port 62. Conduits 22*a*, 22*b* converge adjacent outlet port 62.

A first enlarged bore 70 is transversely disposed in conduit 22*a*. Bore 70 is of a construction sufficient for accommodating a first valve 72 which functions as a means for starting injection. Valve 72 is mounted in housing 24 for rotation in bore 70 in a lapped fit. Valve 72 has an enlarged outer cylindrical surface 76 for lubricated rotating engagement with inner cylindrical surface 77 of bore 70. A reduced diameter portion 78 of valve 72 is adjacent a high pressure inlet 81 and a relatively low pressure outlet 83 at an intersection of conduit 22*a* and bore 70. A raised arcuate blocking shoulder 82 (FIGS. 1 and 2) is formed on reduced diameter portion 78 of valve 72. Outer arcuate surface 84 of shoulder 82 rotatably engages inner surface 76 of bore 70 in a manner sufficient for blocking inlet 81, thus limiting passage of fuel through conduit 22*a* to port 62. Shoulder 82 and thus arcuate surface 84, have a first arcuate length L1 for permitting shoulder 82 to block inlet 81 for a certain duration. Preferably, a balancing shoulder 82*a* is also formed on portion 78 and is of the same size and configuration as blocking shoulder 82 but is diametrically opposed to shoulder 82. Without balancing shoulder 82*a*, relatively high fuel pressure forces acting on surface 84 would tend to deflect valve 72 in bore 70 due to the reduced diameter of portion 78. Blocking shoulder 82 is timed to block inlet 81 when plunger 36 is blocking conduit 20 and is moving toward position "B" when injection can occur. Balancing shoulder 82*a* will block inlet 81 when plunger 36 is not blocking conduit 20 and is moving toward position "A", thus no injection will occur since, as it is well known, injection can occur only when fuel is being compressed in cavity 100.

A second enlarged bore 90 is transversely disposed in conduit 22*b*. Bore 90 is of a construction sufficient for accommodating a second valve 92 which functions as a means for stopping injection. Valve 92 is mounted in housing 24 for rotation in bore 90 in a lapped fit. Valve 92 has an enlarged outer cylindrical surface 96 for lubricated rotating engagement with inner cylindrical surface 97 of bore 90. A reduced diameter portion 98 of valve 92 is adjacent a high pressure inlet 101 and a relatively low pressure outlet 103 at an intersection of conduit 22*b* and bore 90. A raised arcuate blocking shoulder 102 is formed on reduced diameter portion 98 of valve 92. Outer arcuate surface 104 of shoulder 102 rotatably engages inner surface 96 of bore 90 in a manner sufficient for blocking inlet 101, thus limiting passage of fuel through conduit 22*b* to port 62. Shoulder 102, and thus surface 104, have a second arcuate length L2 greater than first arcuate length L1, thus permitting shoulder 102 to block inlet 101 for a greater duration than the duration which shoulder 82 blocks inlet 81. Preferably, a balancing shoulder 102*a* is also formed on portion 98 and is of the same size and configuration as blocking shoulder 102 but is diametrically opposed to shoulder 102. Without balancing shoulder 102*a*, relatively high fuel pressure forces acting on surface 104 would tend to deflect valve 92 in bore 90 due to the reduced diameter of portion 98. Blocking shoulder 102 is timed to block inlet 101 when plunger 36 is blocking conduit 20 and is moving toward position "B" when injection can occur. Balancing shoulder 102*a* will block inlet 101 when plunger 36 is not blocking conduit 20 and is moving toward position "A", thus no injection will occur.

Thus, it can be seen that conduit 22*a* bypasses valve 72, but conduits 22*a*, 22*b* fluidly interconnect first valve 72 and second valve 92 due to their common connection to conduit 22 and port 62. Also, by virtue of interconnected conduits 22*a*, 22*b*, plunger bore 38 is fluidly connected to first valve 72 and second valve 92 permitting conduit 22 to conduct fuel from cavity 100 and simultaneously provide the fuel to first valve 72 and second valve 92.

FIGS. 2, 2A, 2B graphically illustrate the relative positions of valves 72, 92 rotating in bores 70, 90, respectively, for starting and stopping injection. In FIG. 2, with plunger 36 blocking conduit 20, shoulder 102 of valve 92 sequentially blocks intersection 101 but since shoulder 82 of valve 72 is not blocking intersection 81, no injection occurs and fuel bypasses valve 72 from cavity 100 via conduit 22*a* and returns to tank 14. In FIG. 2A, however, shoulders 82,102 simultaneously block their respective intersections 81,101 thus causing pressurized fuel in cavity 100 to inject. In FIG. 2B, shoulder 82 of valve 72 sequentially blocks intersection 81 but since shoulder 102 of valve 92 is not blocking intersection 101, injection stops and fuel bypasses valve 92 from cavity 100 via conduit 22*b* and returns to reservoir 14. Thus it can be seen how shoulder 82 controls injection starting and shoulder 102 controls injection stopping. Continuous rotation of valves 72,92, at the same constant rotational speed causes intermittent blockage of conduit 22. Phasing the relative positions of shoulders 82,102 for sequential and simultaneous blockage of conduit 22 results in control timing and duration of fuel injection.

Figure 3:
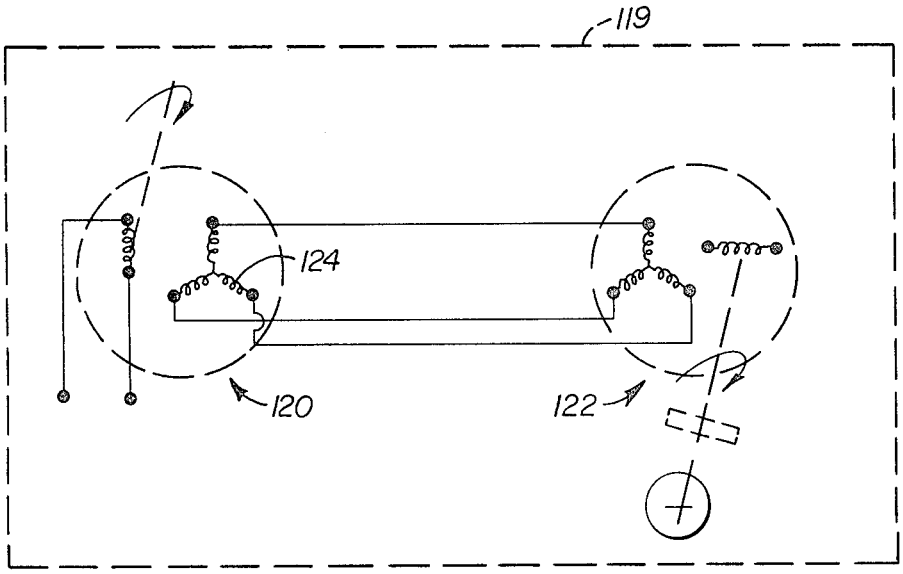
FIG. 3 is a view illustrating an adjustment control of this invention.
Figure 4:
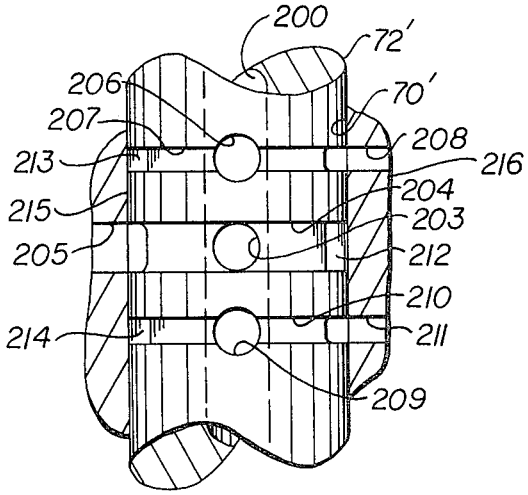
FIG. 4 is a view illustrating an alternative to the apparatus of the invention.

Means 119 are provided for continuously rotating valve 72 and an additional identical means 119 is required to continuously rotate valve 92. However, only one of the identical means 119 is shown in FIG. 3 and described below. Means 119 is preferably electrical, although it is possible to arrange for mechanical rotation of valves 72, 92. Means 119 includes a control transmitter 120, and a contrtol transformer and servo 122. Control transmitter 120 is driven by camshaft 34 at one-half engine speed (for a 4 cycle engine). Such a control transmitter 120, through suitable buffering networks which are well known, directly drives control transformer and servo 122 which rotates valve 72. By adjusting the position of stator 124 of control transmitter 120, the starting of injection is controlled. This is accomplished by adjusting the timed positioning of shoulder 82 of valve 72 relative to cam 34 to precisely set the time when shoulder 82 begins to block inlet 81 thus controlling the starting of injection.

In the additional identical means 119, the control transmitter, also driven by camshaft 34, directly drives control transformer and servo 122 for rotating valve 92. By adjusting stator 124 of control transmitter 120, the stopping of injection is controlled. This is accomplished by adjusting the timed positioning of shoulder 102 of valve 92 relative to shoulder 82 of valve 72 as to precisely when shoulder 102 stops blocking inlet 101 thus controlling the stopping of injection. Electrical equipment for supplying the above-described functions of means 119 is available from commercial sources such as AEROFLEX and the SINGER INSTRUMENT COMPANY, both of the United States of America.

Another electrical means is possible for continuously rotating rotors 72,92 and will be briefly discussed. Such means comprises a digital system, several types of which have been used successfully for various applications requiring precision drives with adjustable phase angles. Such a digital system may be obtained from stepping motor of the type commercially available from HAWKER-SIDDLEY DYNAMICS of Great Britain, but do not have provisions for feedback corrections. However, feedback loop equipment is commercially available from DISC INSTRUMENT CORP. of the United States of America.

Rotating the valves 72,92 at one-half engine speed will result in making one injection of fuel per two engine revolutions in a four cycle engine. A two cycle engine would have valves 72,92 rotating at crank speed since injection frequency is at crank frequency. The arcuate lengths L1, L2 of shoulders 82,102, respectively, may be expressed in rotational degrees. Thus, by controlling the position of shoulder 82 relative to cam 34, the starting of injection can be controlled, and, by controlling the position of shoulder 102 relative to shoulder 82, the stopping of injection can be controlled.

Electrical means are employed to determine the start of injection as well as to determine the quantity of fuel injected. Such means are well known and are not the subject of this invention. These means usually include a power source, sensing devices, actuators, and the like, and take into account inlet manifold pressure and temperature, engine speed and load, and even fuel temperature.

A well known logic system, the universal fuel injection system, UFIS, developed for the military for use in track type or armored vehicles, is available for actuating fuel pump control system. The UFIS reads and interprets vehicle data such as engine speed, boost or manifold pressure, engine temperature, ambient temperature, altitude, load, etc. The UFIS is powered by the vehicular power system, e.g., a twelve (12) or twenty-four (24) volt system or the like. The UFIS logic requires relatively low milliamperage. Thus, the signal produced by the UFIS logic must be matched to provide an appropriate UFIS input to control transmitter 120. UFIS logic can also provide the appropriate adjustment to stator 124 for controlling the position of shoulder 82 relative to cam 34 and the position of shoulder 102 relative to shoulder 82 as discussed above.

As a possible alternative, fuel can be introduced to a central bore 200 of a valve 72' rotating in a valve bore 70'. The fuel can be expelled from valve 72' through a transverse bore 203 and an annulus 204 to a conduit 205. Simultaneously, fuel can be expelled from valve 72' through a transverse bore 206, annulus 207 to a conduit 208 and also through a transverse bore 209, annulus 210 to a conduit 211. When valve 72' is rotated, a blocking shoulder 212 blocks fuel from being expelled through conduit 205. Simultaneously, a shoulder 213 blocks fuel from being expelled though conduit 208 while a shoulder 214 blocks fuel from being expelled through conduit 211. Note that conduit 205 is larger than each of the conduits 208,211. In fact, the total cross-sectional area of conduit 208 and conduit 211 is equal in size to the cross-sectional area of conduit 205.

Also note that conduits 208,211 are diametrically opposed to conduit 205. In this manner, the sum of forces acting on one side 215 of valve 72' are equal and opposite to the sum of forces acting on another side 216 of valve 72', the sides 215,216 being diametrically opposed.

INDUSTRIAL APPLICABILITY

With the parts assembled as set forth above, transfer pump 16 maintains a system pressure at about 30–35 psi. Means 119 rotate valves 72,92 continuously at the same constant rate. Fuel enters housing 24 at port 56 and flows to cavity 100 via conduit 20. The fuel continues through conduit 22 and returns to tank 14 via conduits *22a, 22b* which include valves 72,92 respectively.

Camshaft 34 and lobe 32 rotate and cause plunger 36 to reciprocate between positions "A" and "A". When plunger 36 blocks conduit 20 and continues toward position "B" injection can occur depending now on the timed sequential and simultaneous positioning of shoulders 82 and 102. First in the sequence, shoulder 102 rotates to block inlet 101 but fuel continues to tank 14 via conduit *22a*. Second in the sequence, shoulder 82 simultaneously rotates to block inlet 81 as shoulder 102 continues to block inlet 101 and fuel is trapped in housing 24. Further downward movement of plunger 36 greatly compresses fuel in cavity 100 forcing the fuel past check valve 49 to be injected through port 42. Next in the sequence after injection begins, as plunger 36 continues toward position "B" shoulder 102 rotates to clear inlet 101 and injection stops as fuel resumes flowing to tank 14 via conduit *22b*. Finally, shoulder 82 also clears inlet 81 and fuel again flows to tank 14 via conduit *22a*.

Plunger 36 then begins travel from position "B" to position "A" as balancing shoulders *82a, 102a* rotate past inlets 81,101, respectively, but under these conditions no injection occurs since fuel in cavity 100 is not being compressed. The above-described cycle repeats rapidly.

Signals from the UFIS logic to means 119 can operate through stator 124 to adjust the relative positions of valve shoulders 82,102 through the use of means 119 which rotatably drives valves 72,92. Since the two valves 72,92 rotate continuously at the same constant speed, objectionable inertial forces associated with the prior art are avoided.

The foregoing has described an electrically controlled fuel injection apparatus including first and second continuously rotating valves for starting and stopping fuel injection.

It is anticipated that further aspects of the present invention can be obtained from the foregoing description and the appended claims.

I claim:

1. A fuel injection apparatus (10) comprising:

a housing (24), said housing (24) having a plunger bore (38);

a plunger (36) reciprocally mounted in said plunger bore (38) to define a pumping cavity (100) therein;

means (20,22) for conducting fuel to and from said plunger bore (38) and to the pumping cavity (100) defined therein;

means (72,92) for starting and stopping injection of said fuel, said means being first and second valves (72,92), said first and second valves (72,92) being fluidly interconnected and said first and second valves (72,92) being fluidly connected to said plunger bore (38); and means (119) for continuously rotating said first and second valves (72,92) during sequential and repeated starting and stopping of said injection of said fuel.

2. The apparatus (10) of claim 1 wherein said means (20,22) for conducting fuel to and from said plunger bore (38) includes interconnected fuel conduits (22,22*a*,22*b*) connected to said plunger bore (38) and connected to said first and second valves (72,92).

3. The apparatus (10) of claim 2 wherein said first and second valves (72,92) include blocking shoulders (82,102) intermittently blocking said fuel conduit (22,22*a*,22*b*) in response to rotary movement of said first and second valves (72,92).

4. The apparatus (10) of claim 2 wherein said first valve (72) includes a first annular blocking shoulder (82) of a first size (L1) and said second valve (92) includes a second annular blocking shoulder (102) of a second size (L2) relatively greater than said first shoulder (82).

5. The apparatus (10) of claim 4 wherein said first and second shoulders (82,102) sequentially and simultaneously block said fuel conduit (22,22*a*,22*b*) in response to said continuous rotary movement of said first and said second valves (72,92).

6. The apparatus (10) of claim 1 including:

means (124) for independently rotatably adjusting said first and second valves (72,92).

7. The apparatus (10) of claim 1 wherein said first and second valves (72,92) are axially spaced and formed by a common rotary spool (72').

8. The apparatus of claim 7 further including means (205,208,211) for imposing equal and opposite forces on diametrically opposite sides (215,216) of said spool (72').

9. A fuel injection apparatus (10) comprising:

a housing (24) having a plunger bore (38);

a plunger (36) reciprocally mounted in said plunger bore (38);

inlet and outlet ports (56,62) in said housing (24);

a fuel conduit (20,22,22*a*,22*b*) extending from said inlet port (56) to said plunger bore (38) and from said plunger bore (38) to said outlet port 62); and first and second means for starting and stopping fuel injection, said first and second means being first and second valves (72,92) in said fuel conduit 22 between said plunger bore (38) and said outlet port (62) and being electrically actuated for continuous rotary movement.

10. The apparatus (10) of claim 9 wherein said first valve (72) is in a first valve bore (70) and said second valve (92) is in a second valve bore (90).

11. The apparatus (10) of claim 10 wherein said fuel conduit (22,22*a*,22*b*) fluidly connects said plunger bore (38) simultaneously to said first and second valve bores (70,90).

12. The apparatus (10) of claim 11 wherein said first valve (72) includes a first annular blocking shoulder (82) of a first size (L1) and said second valve (92) includes a second annular blocking shoulder (102) of a second size (L2) relatively greater than said first shoulder (82).

13. The apparatus (10) of claim 12, including:

said first valve (72) includes a first annular balancing shoulder (82*a*) diametrically opposite said first annular blocking shoulder (82) and said second valve (92) includes a second annular balancing shoulder (102*a*) diametrically opposite said second annular blocking shoulder (102).

14. The apparatus (10) of claim 12 wherein said first and second blocking shoulders (82,102) sequentially and simultaneously block said fuel conduit (22,22*a*,22*b*) in response to said continuous rotary movement of said first and second valves (72,92).

15. The apparatus (10) of claim 12 wherein said fuel conduit (22,22*a*,22*b*) includes means (22*b*) for fluidly interconnecting said first valve (72) and said outlet (62), said means (22*b*) bypassing said second valve (92).

16. The apparatus (10) of claim 9 including:

means (124) for independently rotatably adjusting said first and second valves (72,92).

17. A fuel injection system comprising:

a housing (24) having a plunger bore (38);

a plunger (36) reciprocally mounted in said plunger bore (38);

inlet and outlet ports (56,62) in said housing (24);

a fuel conduit (20) extending from said inlet port (56) to said plunger bore (38) and from said plunger bore (38) to said outlet port (62);

a fuel reservoir (14);

means (16) for pumping fuel from said reservoir (14) to said inlet port (56); and means for starting and stopping injection of said fuel, said means being first and second valves (72,92) in said fuel conduit (22*b*) and being electrically actuated for continuous rotary movement.

18. In a fuel injection apparatus of the type including a housing (24) having a plunger in a plunger reciprocally mounted bore and a conduit )20,22,22*a*,22*b*) conducting fuel through the housing, to and from the bore, the improvement comprising:

means for starting and stopping injection of said fuel, said means being a first valve (72) continuously rotating at a constant speed in a first portion (22*a*) of said conduit, and a second valve (92) continuously rotating at a constant speed in a second portion (22*b*) of said conduit.

19. A fuel injection apparatus (10) comprising:

a housing (24), said housing (24) having a plunger bore (38);

a plunger (36) reciprocally mounted in said plunger bore (38);

means (20,22,22*a*,22*b*) for conducting fuel to and from said plunger bore (38); and means for starting and stopping injection of said fuel, said means being first and second valves (72,92) said first and second valves (72,92) being fluidly interconnected and said first and second valves (72,92) being fluidly connected to said plunger bore (38), said first valve (72) continuously rotating at a constant speed in timed relationship with said plunger (36), said second valve (92) continuously rotating at said constant speed in timed relationship to said first valve (72).

20. The apparatus of claim 19 including:

means (124) for adjusting said timed relationship.

21. In a fuel injection apparatus (10) having a source of fuel (14,16), pressure-responsive nozzle means (44) for ejecting fuel therefrom in response to fuel pressure exceeding a predetermined level therein, and pump means (36) for communicating pressurized fuel from a pumping cavity (100) thereof to said nozzle means, the improvment comprising:

continuously rotating first valve means (72) for controlling the pressurization of fuel in said pumping cavity (100) to start ejection of fuel through said nozzle means (44) and continuously rotating second valve means (92) for controlling the pressurization of fuel in said pumping cavity (100) to stop ejection of fuel through said nozzle means (44), said first (72) and second (92) valve means being in fluid communication.

22. The apparatus (10) of claim 21 wherein said first valve means (72) includes first shoulder means (82) for continuously rotating between open and closed positions, said second valve means (92) including second shoulder means (102) for rotating between open and closed positions, each said open position communicating said pumping cavity (100) with said source (14,16) and each said closed position blocking communication of said pumping cavity (100) with said source (14,16) and each said closed position blocking communication of said pumping cavity (100) with said source (14,16), said first (82) and second (102) shoulder means timed in their continuous rotation so that sequentially (I) said first shoulder means (82) is open when said second shoulder means (102) is closed, (II) said first shoulder means (82) is closed when said second shoulder means (102) is closed, (III) said first shoulder means (82) is closed when said second shoulder means (102) is open, and (IV) said first shoulder means (82) is open when said second shoulder means (102) is open.

23. The apparatus (10) of claim 21 wherein said first and second valve means (72,92) are formed by a common rotary spool (72').

24. The apparatus (10) of claim 23 further including means (205,208,211) for imposing equal and opposite forces on diametrically opposite sides (215,216) of said spool (72').

* * * * *